US007049280B2

(12) United States Patent
Angell et al.

(10) Patent No.: US 7,049,280 B2
(45) Date of Patent: May 23, 2006

(54) PROCESS FOR MAKING LAUNDRY DETERGENT COMPOSITION HAVING GRANULAR CYCLODEXTRIN FOR REMOVING MALODOR FROM LAUNDERED ITEMS

(75) Inventors: Adrian John Wayneforth Angell, West Chester, OH (US); Paul Amaat France, West Chester, OH (US)

(73) Assignee: The Procter & Gamble company, Cincinnati, OH (US)

( * ) Notice: Subject to any disclaimer, the term of this patent is extended or adjusted under 35 U.S.C. 154(b) by 0 days.

(21) Appl. No.: 11/067,878

(22) Filed: Feb. 28, 2005

(65) Prior Publication Data

US 2005/0143272 A1 Jun. 30, 2005

Related U.S. Application Data

(60) Division of application No. 10/087,316, filed on Mar. 1, 2002, now Pat. No. 6,881,712, which is a continuation of application No. PCT/US00/22851, filed on Aug. 21, 2000.

(60) Provisional application No. 60/152,389, filed on Sep. 3, 1999, provisional application No. 60/152,395, filed on Sep. 3, 1999, provisional application No. 60/152,251, filed on Sep. 3, 1999.

(51) Int. Cl.
*C11D 11/00* (2006.01)
*D06L 1/12* (2006.01)

(52) U.S. Cl. ..... 510/444; 510/276; 510/470; 264/140; 8/137

(58) Field of Classification Search ..... 510/513, 510/276, 444, 470; 264/140; 8/137
See application file for complete search history.

(56) References Cited

U.S. PATENT DOCUMENTS

| | | | | |
|---|---|---|---|---|
| 4,992,198 | A | 2/1991 | Nebashi et al. | |
| 5,648,328 | A | 7/1997 | Angell et al. | |
| 5,656,584 | A | 8/1997 | Angell et al. | |
| 5,660,845 | A | 8/1997 | Trinh et al. | |
| 5,681,806 | A | 10/1997 | Trinh et al. | |
| 5,714,445 | A * | 2/1998 | Trinh et al. | 510/103 |
| 5,773,408 | A | 6/1998 | Trinh et al. | |
| 5,783,552 | A | 7/1998 | Trinh et al. | |
| 5,853,430 | A | 12/1998 | Shindo et al. | |
| 5,885,599 | A | 3/1999 | Peterson et al. | |
| 5,935,769 | A * | 8/1999 | Tsukada | 430/440 |
| 6,368,591 | B1 * | 4/2002 | Chen et al. | 424/93.45 |

FOREIGN PATENT DOCUMENTS

| | | |
|---|---|---|
| JP | 01-256596 | 10/1989 |
| JP | 01-256597 | 10/1989 |
| JP | 02-034693 | 2/1990 |
| JP | 08310933 A * | 11/1996 |
| WO | WO 97/47720 A2 | 12/1997 |
| WO | WO 98/12298 A2 | 3/1998 |
| WO | WO 98/13456 | 4/1998 |
| WO | 197 18 978 A1 | 11/1998 |
| WO | WO 98/56888 | 12/1998 |

* cited by examiner

*Primary Examiner*—Lorna M. Douyon
(74) *Attorney, Agent, or Firm*—Julia A. Glazer; Jerry J. Yetter; David V. Upite

(57) ABSTRACT

Free-flowing cyclodextrin is made by combining water soluble, substantially perfume-free cyclodextrin with inorganic compounds, especially zeolites. The cyclodextrin is used in a laundry detergent product capable of removing malodor from laundered items during an automatic laundry washing process.

18 Claims, No Drawings

PROCESS FOR MAKING LAUNDRY DETERGENT COMPOSITION HAVING GRANULAR CYCLODEXTRIN FOR REMOVING MALODOR FROM LAUNDERED ITEMS

CROSS REFERENCE TO RELATED APPLICATIONS

This application is a divisional application of U.S. application Ser. No. 10/087,316 filed on Mar. 1, 2002, now U.S. Pat. No. 6,881,712, which is a continuation of International Application PCT/US00/22851, filed Aug. 21, 2000, which claims the benefit of provisional Application Ser. Nos. 60/152,389, 60/152,395, and 60/152,251, all filed Sep. 3, 1999.

TECHNICAL FIELD

The present invention relates to a laundry detergent compositions and more particularly, to a laundry detergent composition which is incorporated with a stable, quick dissolving, free flowing cyclodextrin in a granular form for removing malodor from laundered items during automatic washing, and a process for forming the same. The present invention also relates to a process for forming a free flowing cyclodextrin capable of removing malodor from laundered items during automatic laundry washing when the cyclodextrin is incorporated into a laundry detergent composition is disclosed. The present invention additionally relates to a process for removing malodor from laundered items during laundry washing by providing a potent form of a stable, quick dissolving, free flowing cyclodextrin in a granular form for ad-mixing in a detergent composition.

BACKGROUND OF THE INVENTION

The present invention relates to a laundry detergent composition which is incorporated with a stable, quick dissolving, free flowing cyclodextrin in a granular form for removing malodor from laundered items during automatic washing, and a process for forming a non-gelling, quick dissolving, free flowing cyclodextrin in a granular form for improving the malodor control properties of a laundry detergent composition. The purpose of this invention is to provide a laundry detergent composition and a process that enables one to incorporate cyclodextrin directly into laundry detergent compositions so as to improve the odor absorbing and wrinkle controlling properties of the laundry detergent product formed from such a laundry detergent composition, in such a way that when inanimate surfaces, primarily fabrics, and especially cotton fabrics are washed, any odors contained therein are substantially removed. The cyclodextrin containing laundry detergents made by the process of this invention can also be used for washing other inanimate surfaces, such as household upholsteries, drapes, carpets, rugs, and the like.

While cyclodextrin is a known odor absorbing material, it is commercially available only in the form of a fine amorphous powder which is not free-flowing, extremely dusting, and also explosive. Consequently, it has heretofore not only been very difficult, but even hazardous to incorporate cyclodextrin into a granular detergent composition because of processing limitations, and because of the explosive nature of non-complexed cyclodextrin.

It has been desirable to have a laundry detergent composition in particulate and non-particulate form which is adapted to remove malodor from heavily soiled and smelly clothes, such as those worn by butchers, mechanics and the like, and a process for forming a free flowing cyclodextrin in a granular form which can be incorporated into a granular laundry detergent composition, and which is easily dissolvable along with the rest of the laundry detergent composition ingredients in the wash solution during automatic fabric washing, such that the cyclodextrin retains a substantially full odor absorbing and odor entrapping strength, so that it is most active in removing malodor from heavily soiled and smelly laundry items.

It has been recognized by the inventors of this particular invention that it is extremely advantageous to have a detergent composition which has a unique form of cyclodextrin granules, i.e., those having an Odor Loading factor of at least about 50, as defined herein, and a method of forming a free-flowing, non-gelling, dissolvable, granular form of cyclodextrin similar in size and shape to the base granules of the laundry detergent composition, so that any useful level of the cyclodextrin may be incorporated in the overall laundry detergent composition without adversely affecting its flowability and scoopability properties and at the same time imparting the useful odor-controlling properties of cyclodextrin to the laundry detergent composition, to effectively remove most of the malodor from excessively smelly clothes.

The present invention overcomes the problems, as set forth above.

BACKGROUND ART

U.S. patent application Ser. No. 08/871,042, filed on Jun. 9, 1997 and assigned to the assignee of the present invention, which is currently pending, describes stable, preferably clear, aqueous odor-absorbing compositions, articles of manufacture, and/or method of use, comprising solubilized, uncomplexed cyclodextrin, and cyclodextrin compatible antimicrobial active, cyclodextrin compatible surfactant, cyclodextrin compatible humectant, hydrophilic perfume providing improved acceptance, or mixtures thereof.

Japanese Patent Application JP 02034693, assigned to Kao Corporation, discloses a powder detergent composition based on a synthetic anionic surfactant, which contains, amongst other ingredients, 0.1% to 5% by weight of cyclodextrin. The purpose of the cyclodextrin is to remove the odor of the soap due to the inclusion ability of cyclodextrin Japanese Patent Application JP 01256596, assigned to Kao Corporation, discloses a powder detergent composition having enzymes, which includes from 0.1% to 5% by weight of an inclusion compound, such as beta-cyclodextrin for controlling the odor and deodorising the enzymes present in the powder detergent and the enzymes present in the washing water, and also for improving the stability of enzymes against chlorine in tap water.

Japanese Patent Application JP 01256597, assigned to Kao Corporation, discloses a powder detergent composition containing cyclodextrin for controlling the emission of unpleasant smells from the sulphonates, ester salts and amine oxides present in the detergent composition.

WO 9813456 patent publication, assigne dto Henkel Ecolab GMBH & Co, discloses a powder, paste or liquid detergent or post wash treatment agent containing as an additive, cyclodextrin, for the purpose of increasing the solubility of nonionic surfactants.

SUMMARY OF THE INVENTION

The invention meets the needs above by providing a laundry detergent product capable of removing malodor from laundered items during an automatic laundry washing process, and a non-particulate detergent product.

In one aspect of the present invention, a laundry detergent product capable of removing malodor from laundered items during an automatic laundry washing process is disclosed. The laundry detergent comprises: (a) cyclodextrin granules formed from a mixture of cyclodextrin powder, an inorganic compound and an aqueous medium, the cyclodextrin granules having a particle size in a range of from about 100 microns to about 1200 microns; (b) a laundry detergent composition including a surfactant, a builder and an enzyme; and (c) the laundry detergent product being adapted to readily dissolve and disperse the cyclodextrin granules into a wash solution when the laundry detergent product is used in the above automatic laundry washing process, and wherein the cyclodextrin, when released into the above wash solution, has an odor loading factor of at least about 50.

In another aspect of the present invention, a non-particulate laundry detergent product is made from a particulate detergent composition having granular cyclodextrin, as disclosed above.

The present invention also relates to a process for forming a free flowing cyclodextrin capable of removing malodor from laundered items during automatic laundry washing when the cyclodextrin is incorporated into a laundry detergent composition is disclosed. The process comprises the steps of: (a) forming cyclodextrin granules from a mixture of cyclodextrin powder, an inorganic compound selected from the group consisting of sulfates, carbonates, silicates, aluminosilicates, phosphates, silica, citrates, perborate, talc and mixtures thereof, and an aqueous medium, (b) particulizing the cyclodextrin granules to a particle size in a range of from about 100 microns to about 1200 microns; and (c) forming selected cyclodextrin granules that have an odor loading factor of at least about 50 when the cyclodextrin granules are dispersed in a wash solution during an automatic laundry washing process, after the cyclodextrin granules are ad-mixed into a laundry detergent composition.

It is further an object of the present invention to provide a process for removing malodor from laundered items during laundry washing by providing a potent form of a stable, quick dissolving, free flowing cyclodextrin in a granular form for ad-mixing in a detergent composition.

These and other objects, features and attendant advantages of the present invention will become apparent to those skilled in the art from a reading of the following detailed description of the preferred embodiment and the appended claims.

DETAILED DESCRIPTION OF THE INVENTION

In the preferred embodiment of the present invention, a laundry detergent product capable of removing malodor from laundered items during an automatic laundry washing comprises cyclodextrin granules formed from a mixture of cyclodextrin powder, an inorganic compound and an aqueous medium.

In the preferred embodiment, the detergent product also comprises a laundry detergent composition including a surfactant, a builder and an enzyme. Examples of such standard laundry detergent ingredients, which are well known to those skilled in the art, are provided in the following paragraphs.

In the preferred embodiment, the laundry detergent product is adapted to readily dissolve and disperse the cyclodextrin granules into a wash solution when the laundry detergent product is used in the above automatic laundry washing process. The cyclodextrin, when released into the above wash solution, has an odor loading factor of at least about 50.

In the preferred embodiment, the cyclodextrin granules are formed using a granulating process selected from the group consisting of agglomeration, spray-drying, extrusion, fluid-bed agglomeration, roll-compaction, freeze-drying, and tabletting. Such processes are well known and are described later in this specification.

In the preferred embodiment, the inorganic compound is selected from the group consisting of sulfates, carbonates, silicates, aluminosilicates, phosphates, silica, citrates, perborate, talc and mixtures thereof. Preferably, the inorganic compound is an aluminosilicate ion exchange material of the formula, $Mm/n[(AlO_2)m(SiO_2)y].xH_2O$ where n is the valence of the cation M, x is the number of water molecules per unit cell, m and y are the total number of tetrahedra per unit cell, and y/m is 1 to 100, and wherein M is selected from the group consisting of sodium, potassium, magnesium, and calcium. Even more preferably, the inorganic compound is zeolite.

Alternatively, the inorganic compound is a hygroscopic powder selected from the group consisting of polymers or co-polymers of acrylic and maleic acid, polyvinyl pyrrolidone, polyvinyl pyrridine N oxide, carboxylmethyl cellulose, polyaspartate and starch, and mixtures thereof.

In the preferred embodiment, the cyclodextrin powder and the inorganic compound are mixed in a weight ratio in a range of from about 10:90 to about 90:10 respectively.

In the preferred embodiment, the cyclodextrin granules and the laundry detergent composition are mixed in a weight ratio in a range of from about 0.1:99.90 to about 50:50, cyclodextrin granules:laundry detergent composition. Preferably, the granular cyclodextrin ranges from about 0.05% to about 50% by weight and the detergent composition that the cyclodextrin is ad-mixed into, ranges from about 0.1% to about 99.9% by weight.

In an additional embodiment of the present invention a process for removing malodor from laundered items during automatic laundry washing comprises the steps of: (a) providing a laundry detergent composition containing laundry detergent ingredients and cyclodextrin, the cyclodextrin being in a granular form, the cyclodextrin being complexed with an inorganic compound selected from the group consisting of sulfates, carbonates, silicates, aluminosilicates, phosphates, silica, citrates, perborate, talc and mixtures thereof, and the cyclodextrin having a loading factor of at least about 50. By the term "complexed" it is meant that the cyclodextrin is processed with an inorganic compound and formed into granules that are a combination of cyclodextrin and inorganic compound in a desired weight ratio.

In the preferred embodiment of yet another aspect of the present invention, a method of using cyclodextrin in a laundry detergent composition for removing malodor from laundered items during automatic laundry washing comprises the steps of: (a) forming cyclodextrin granules from a mixture of cyclodextrim powder, an inorganic compound selected from the group consisting of sulfates, carbonates, silicates, aluminosilicates, phosphates, silica, citrates, perborate, talc and mixtures thereof, and an aqueous medium;

(b) particulizing the cyclodextrin granules to a particle size in a range of from about 100 microns to about 1200 microns; (c) ad-mixing the cyclodextrin granules in a laundry detergent composition, in a range of from about 0.1% to about 50% by weight cyclodextrin granules; and (d) forming a laundry detergent product having cyclodextrin granules that have an odor loading factor of at least about 50 when the cyclodextrin granules are dispersed in a wash solution during an automatic laundry washing process.

Size of Cyclodextrin Granules

In the preferred embodiment of the present invention, the cyclodextrin granules have a particle size in a range of from about 100 microns to about 1200 microns. Preferably, the cyclodextrin granules have a size in a range of from about 200 microns to about 800 microns.

Odor Loading Factor

The term Odor Loading Factor, as used herein, means the ability of the cyclodextrin to absorb odor. It is defined as the percentage of cyclodextrin internal cavity volume available to accept a guest, i.e., the odor or water molecules bearing odor. For example, an Odor Loading Factor of 10 means only 10% of a cyclodextrin molceule's rigid conical hollow internal cavity is available for accepting a host molecule, on a volume basis. Thus, in other words, an Odor Loading Factor of 10 means that only 10% of the total capacity of the cyclodextrin is available to absorb odor. Conversely, an Odor Loading Factor of 10 means that 90% of the cyclodextrin's odor absorbing capacity, or its ability as an inclusion compound, is used up. Thus, an Odor Loading Factor of 10 is undesirable. On the other hand, an Odor Loading Factor (OLF) of 50 is desirable and an OLF of 85 is most preferable. An OLF of 85 means that 85% of the cyclodextrin's odor absorbing capacity is available when the cyclodextrin is released into the wash solution during laundry process, to absorb the malodor from the smelly clothes being laundered.

In the preferred embodiment of the present invention, the cyclodextrin granules have an odor loading factor of at least about 50 when the cyclodextrin granules are dispersed in a wash solution during an automatic laundry washing process, after the cyclodextrin granules are ad-mixed into a laundry detergent composition. Preferably, the cyclodextrin granules have an Odor Loading Factor of at least about 65 and even more preferably, the cyclodextrin granules have a odor loading factor of at least about 80.

Process for Forming Free-flowing Granular Cyclodextrin with an Inorganic Compound A free flowing cyclodextrin in a granular form is formed by admixing cyclodextrin and an inorganic compound to form a mixture; agglomerating the mixture in an aqueous medium to form cyclodextrin agglomerate; and drying the cyclodextrin agglomerate. said step of admixing includes mixing and granulating said cyclodextrin and said inorganic compound in one or more of a high-speed mixer and granulator. The step of agglomerating includes forming a cyclodextrin-inorganic compound pre-mix with water. Preferably, the cyclodextrin and the inorganic compound are admixed in a weight ratio in a range of from about 10:90 to about 90:10 respectively. The mixture and the aqueous medium are preferably pre-mixed before agglomerating, in a weight ratio in a range of from about 10:90 to about 90:10 respectively.

In another aspect of the present invention, a process for forming a free flowing cyclodextrin in a granular form for being ad-mixable into a granular detergent composition includes the steps of: (a) continuously mixing a detergent surfactant paste and dry starting detergent material including cyclodextrin in a powder form, in a high speed mixer or densifier, to obtain cyclodextrin-detergent agglomerates, the ratio of the surfactant paste to the dry material including cyclodextrin being from about 1:10 to about 10:1; (b) mixing cyclodextrin-detergent agglomerates in a moderate speed mixer or densifier, to further densify the agglomerates to a density in a range of from about 500 grams/L to about 1000 grams/L; and (c) drying the cyclodextrin-detergent agglomerates to form a free-flowing cyclodextrin in a granular form capable of being ad-mixed in a granular detergent composition.

In another aspect of the present invention, a non-particulate detergent product, such as in tablet, bars, bar-soaps, compressed particulate bars etc., is disclosed. The non-particulate laundry detergent product includes a core formed by compacting a particulate detergent product of claim 1 to a density of at least about 1000 g/l, said particulate detergent product having a bulk density in a range of from about 600 g/l to about 850 g/l. The non-particulate detergent product is formed according to the composition described above, including granular cyclodextrin.

Cyclodextrins

The kinds of soils that are most likely to cause a severe malodor in fabrics include: soils like those found on mechanics' clothes; food handlers, especially butchers' and kitchen workers' clothes; sewer workers' clothes; bar tenders' clothes; fire fighters' clothes; farm clothes; athletic clothing; factory workers' clothes; heavy machinery operators' clothes; etc. Such soils have an associated malodor that is almost impossible to counteract without the present invention. Such soils also have a relatively high level of hydrophobic soils such as lubricating oil, grease, food oils, body soils, smoke etc. The preferred cyclodextrin malodor counteractant improves the removal of such soils.

For control of malodors, beta cyclodextrin and alpha cyclodextrin are preferred. Gamma cyclodextrin has too large a casvity to control most malodor molecules. Substituted cyclodextrins can be especially valuable where they are more soluble than the corresponding unsubstituted cyclodextrin. Because cyclodextrins can complex with surfactants and perfumes in the wash or rinse waters, thus it is important to disperse the cyclodextrin in the wash solution in as "potent" a form as possible. Without being bound to any theory as such, it is believed that the heart of this invention is the ability of the procesof this invention to deliver granular form of cyclodextrin which is very potent, in that sense that it has at least 50% of its available capacity to absorb odor, as soon as possible on contact with malodor bearing clothes in the wash solution. This concept is explained later in terms of an "odor loading factor". It is found very surprisingly that the cyclodextrin is not inactivated by the surfactant in the detergent due to the granular form of the cyclodextrin, as made by the present process. Using a granular cyclodextrin rather than pure cyclodextrin in powder form to the detergent composition minimizes the interaction of the cyclodextrin with the ingredients of the detergent and/or softening compositions.

Furthermore, it is believed that the granular form of cyclodextrin does not form any complexes with the actives in the detergent composition. Cyclodextrin that is used up to remove odors from the detergent ingredients or to solubilize surfactants is not available for malodor control. At the heart of this invention is the ability to deliver this "non-used up cyclodextrin" or "potent" cyclodextrin directly into the wash solution, to absorb the maximum possible malodor from the fabrics being washed. Thus the granular cyclodextrin made by the process of the present invention is preferably substantially free of materials that will complex with the cyclodextrin, such as enzymes, nonionic surfactants that will complex with the cyclodextrin, maltitol hydroxyl aliphatic ether, cationic softener molecules containing straight alkyl chains, fatty acids and their soaps and derivatives thereof, perfumes that complex with the cyclodextrin, etc.

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins a rigid, conical molecular structures with hollow interiors of specific volumes. The "lining" of each internal cavity is formed by hydrogen atoms and glycosidic bridging oxygen atoms; therefore, this surface is fairly hydrophobic. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may, or may not, contain reactive functional groups. The complexation between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels on wet fabrics. As the water is being removed however, e.g., the fabric is being dried off, some low molecular weight organic amines and acids have more affinity and will complex with the cyclodextrins more readily.

The cavities within the cyclodextrin in the solution of the present invention should remain essentially unfilled (the cyclodextrin remains uncomplexed) while in solution, in order to allow the cyclodextrin to absorb various odor molecules when the solution is applied to a surface. Non-derivatised (normal) beta-cyclodextrin can be present at a level up to its solubility limit of about 1.85% (about 1.85 g in 100 grams of water) under the conditions of use at room temperature.

Preferably, the cyclodextrins used in the present invention are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a —CH2—CH(OH)—CH3 or a —CH2CH2—OH group; branched cyclodextrins such as maltose-bonded cyclodextrins; cationic cyclodextrins such as those containing 2-hydroxy-3-(dimethylamino)propyl ether, wherein R is CH2—CH(OH)—CH2—N(CH3)2 which is cationic at low pH; quaternary ammonium, e.g., 2-hydroxy-3-(trimethylammonio)propyl ether chloride groups, wherein R is CH2—CH(OH)—CH2—N+(CH3)3Cl—; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, said references being incorporated herein by reference; and mixtures thereof. Other cyclodextrin derivatives are disclosed in U.S. Pat. No. 3,426,011, Parmerter et al., issued Feb. 4, 1969; U.S. Pat. Nos. 3,453,257; 3,453,258; 3,453,259; and 3,453,260, all in the names of Parmerter et al., and all issued Jul. 1, 1969; U.S. Pat. No. 3,459,731, Gramera et al., issued Aug. 5, 1969; U.S. Pat. No. 3,553,191, Parmerter et al., issued Jan. 5, 1971; U.S. Pat. No. 3,565,887, Parmerter et al., issued Feb. 23, 1971; U.S. Pat. No. 4,535,152, Szejtli et al., issued Aug. 13, 1985; U.S. Pat. No. 4,616,008, Hirai et al., issued Oct. 7, 1986; U.S. Pat. No. 4,678,598, Ogino et al., issued Jul. 7, 1987; U.S. Pat. No. 4,638,058, Brandt et al., issued Jan. 20, 1987; and U.S. Pat. No. 4,746,734, Tsuchiyama et al., issued May 24, 1988; all of said patents being incorporated herein by reference.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odor control performance. Solubilized, water-soluble cyclodextrin can exhibit more efficient odor control performance than non-water-soluble cyclodextrin when deposited onto surfaces, especially fabric.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-b-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. Such mixtures absorb odors more broadly by complexing with a wider range of odoriferous molecules having a wider range of molecular sizes. Preferably at least a portion of the cyclodextrins is alpha-cyclodextrin and its derivatives thereof, gamma-cyclodextrin and its derivatives thereof, and/or derivatised beta-cyclodextrin, more preferably a mixture of alpha-cyclodextrin, or an alpha-cyclodextrin derivative, and derivatised beta-cyclodextrin, even more preferably a mixture of derivatised alpha-cyclodextrin and derivatised beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

Uncomplexed cyclodextrin molecules, which are made up of varying numbers of glucose units provide the absorbing advantages of known absorbent deodorizing compositions without harmful effects to fabrics. While cyclodextrin is an effective odor absorbing active, some small molecules are not sufficiently absorbed by the cyclodextrin molecules because the cavity of the cyclodextrin molecule may be too large to adequately hold the smaller organic molecule. If a small sized organic odor molecule is not sufficiently absorbed into the cyclodextrin cavity, a substantial amount of malodor can remain. In order to alleviate this problem, low molecular weight polyols can be added to the composition as discussed hereinafter, to enhance the formation of cyclodextrin inclusion complexes. Furthermore, optional water soluble metal salts can be added as discussed hereinafter, to complex with some nitrogen-containing and sulfur-containing malodor molecules.

Aluminosilicate Material

In the preferred embodiment of the present invention, the structural formula of an aluminosilicate material is based on the crystal unit cell, the smallest unit of structure represented by:

$$Mm/n[(AlO_2)m(SiO_2)y].xH_2O$$

where n is the valence of the cation M, x is the number of water molecules per unit cell, m and y are the total number of tetrahedra per unit cell, and y/m is 1 to 100. Most preferably, y/m is 1 to 5. The cation M can be Group IA and Group IIA elements, such as sodium, potassium, magnesium, and calcium. The preferred aluminosilicate materials are zeolites. The most preferred zeolites are zeolite A, zeolite X, zeolite Y, zeolite P, zeolite MAP and mixtures thereof.

The aluminosilicate ion exchange materials used herein have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp cyclodextrin agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

In a preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Laundry Detergent Composition

In the preferred embodiment, the laundry detergent composition powder has a composition including a cyclodextrin agglomerate made according to the present invention and incorporated into the laundry detergent composition. The laundry detergent composition also comprises a builder made by agglomeration or spray dried process, sodium carbonate, sodium sulfate, sodium tripolyphosphate, anionic and nonionic surfactants and balance water. Laundry detergent powders compositions are well known in the art and various examples of various laundry detergent compositions are disclosed, for example in U.S. Pat. No. 5,554,587, issued to Scott W. Capeci, and assigned to The Procter & Gamble Company.

Cyclodextrin Agglomerates Made by Agglomeration Process

In the preferred embodiment of the present invention, the cyclodextrin agglomerates are made by an agglomeration process.

The Agglomeration Process

The agglomeration process comprises the steps of:

i) admixing one or more ingredients to form a mixture; and ii) agglomerating the mixture to form agglomerated particles or "agglomerates", and iii) drying the agglomerate.

Typically, such an agglomeration process involves mixing the ingredients in one or more agglomerators such as a pan agglomerator, a Z-blade mixer or more preferably in-line mixers, preferably two, such as those manufactured by Schugi (Holland) BV, 29 Chroomstraat 8211 AS, Lelystad, Netherlands, and Gebruder Lodige Maschinenbau GmbH, D-4790 Paderborn 1, Elsenerstrasse 7-9, Postfach 2050, Germany. Preferably a high shear mixer is used, such as a Lödige CB (Trade Name). Most preferably, a high shear mixer is used in combination with a low shear mixer, such as a Lödige CB (Trade Name) and a Lödige KM (Trade name) or Schugi KM (Trade Name). Optionally, only one or more low shear mixer are used. Preferably, the agglomerates are thereafter dried and/ or cooled. An excellent description of an agglomeration process is contained in U.S. Pat. No. 5,554,587, issued to Scott W. Capeci, and assigned to The Procter & Gamble Company.

Another agglomeration process involves mixing of various components of the final agglomerate in different stages, using an fluidized bed. For example, a detergent powder can be agglomerated by spraying on of surfactants and optionally a wax, or mixtures thereof, to the acid source in powdered form and other optional ingredients. Then, additional components, including the perborate bleach and optionally the alkali source or part thereof, can be added and agglomerated in one or more stages, thus forming the final agglomerate particle.

The agglomerates may take the form of flakes, prills, marumes, noodles, ribbons, but preferably take the form of granules. A preferred way to process the particles is by agglomerating dry material powders (e.g. aluminosilicate, carbonate) with high active surfactant pastes and to control the particle size of the resulting agglomerates within specified limits. Typical particle sizes are from 0.10 mm to 5.0 mm in diameter, preferably from 0.25 mm to 3.0 mm in diameter, most preferably from 0.40 mm to 1.00 mm in diameter. Typically, the "agglomerates" have a bulk density desirably, of at least 700 g/l and preferably, in a range of from about 700 g/l to about 900 g/l.

Adjunct Detergent Ingredients

The adjunct ingredients include other detergency builders, bleaches, bleach activators, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

Surfactants

Anionic Surfactant—The preferred anionic surfactants include $C_{11}$–$C_{18}$ alkyl benzene sulfonates (LAS) and primary, branched-chain and random $C_{10}$–$C_{20}$ alkyl sulfates (AS), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y$ $(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters.

Generally speaking, anionic surfactants useful herein are disclosed in U.S. Pat. No. 4,285,841, Barrat et al, issued Aug. 25, 1981, and in U.S. Pat. No. 3,919,678, Laughlin et al, issued Dec. 30, 1975.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil.

Other anionic surfactants herein are the water-soluble salts of alkyl phenol ethylene oxide ether sulfates containing from about 1 to about 4 units of ethylene oxide per molecule and from about 8 to about 12 carbon atoms in the alkyl group.

Other useful anionic surfactants herein include the water-soluble salts of esters of a-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and b-alkyloxy alkane sulfonates containing from about 1 to 3 carbon atoms in the alkyl group and from about 8 to 20 carbon atoms in the alkane moiety.

Other useful anionic surfactants herein are the alkyl polyethoxylate sulfates of the formula $$RO(C_2H_4O)_xSO_3^-M^+$$

wherein R is an alkyl chain having from about 10 to about 22 carbon atoms, saturated or unsaturated, M is a cation which makes the compound water-soluble, especially an alkali metal, ammonium or substituted ammonium cation, and x averages from about 1 to about 15.

Other alkyl sulfate surfactants are the non-ethoxylated $C_{12-15}$ primary and secondary alkyl sulfates. Under cold water washing conditions, i.e., less than abut 65° F. (18.3° C.), it is preferred that there be a mixture of such ethoxylated and non-ethoxylated alkyl sulfates. Examples of fatty acids include capric, lauric, myristic, palmitic, stearic, arachidic, and behenic acid. Other fatty acids include palmitoleic, oleic, linoleic, linolenic, and ricinoleic acid.

Nonionic Surfactant—Conventional nonionic and amphoteric surfactants include $C_{12}$–$C_{18}$ alkyl ethoxylates (AE) including the so-called narrow peaked alkyl ethoxylates and $C_6$–$C_{12}$ alkyl phenol alkoxylates (especially ethoxylates and mixed ethoxy/propoxy). The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Examples of nonionic surfactants are described in U.S. Pat. No. 4,285,841, Barrat et al, issued Aug. 25, 1981.

Examples of surfactants also include ethoxylated alcohols and ethoxylated alkyl phenols of the formula $R(OC_2H_4)_n$ OH, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981. Other surfactants include ethoxylated alcohols having an average of from about 10 to abut 15 carbon atoms in the alcohol and an average degree of ethoxylation of from about 6 to about 12 moles of ethylene oxide per mole of alcohol. Mixtures of anionic and nonionic surfactants are especially useful.

Other conventional useful surfactants are listed in standard texts, including polyhydroxy fatty acid amides, alkyl glucosides, polyalkyl glucosides, $C_{12}$–$C_{18}$ betaines and sulfobetaines (sultaines). Examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing.

Cationic Surfactants

One class of useful cationic surfactants are the mono alkyl quaternary ammonium surfactants although any cationic surfactant useful in detergent compositions are suitable for use herein.

The cationic surfactants which can be used herein include quaternary ammonium surfactants of the formula:

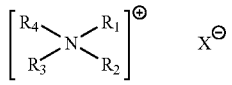

wherein $R_1$ and $R_2$ are individually selected from the group consisting of $C_1$–$C_4$ alky, $C_1$–$C_4$ hydroxy alkyl, benzyl, and —$(C_2H_4O)_xH$ where x has a value from about 2 to about 5; X is an anion; and (1) $R_3$ and $R_4$ are each a $C_6$–$C_{14}$ alkyl or (2) $R_3$ is a $C_6C_{18}$ alkyl, and $R_4$ is selected from the group consisting of $C_1$–$C_{10}$ alkyl, $C_1$–$C_{10}$ hydroxyalkyl, benzyl, and —$(C_2H_4O)_xH$ where x has a value from 2 to 5.

Other useful quaternary ammonium surfactants are the chloride, bromide, and methylsulfate salts. Examples of desirable mono-long chain alkyl quaternary ammonium surfactants are those wherein $R_1$, $R_2$, and $R_4$ are each methyl and $R_3$ is a $C_8$–$C_{16}$ alkyl; or wherein $R_3$ is $C_{8-18}$ alkyl and $R_1$, $R_2$, and $R_4$ are selected from methyl and hydroxyalkyl moieties. Lauryl trimethyl ammonium chloride, myristyl trimethyl ammonium chloride, palmityl trimethyl ammonium chloride, coconut trimethylammonium chloride, coconut trimethylammonium methylsulfate, coconut dimethyl-monohydroxy-ethylammonium chloride, coconut dimethyl-monohydroxyethylammonium methylsulfate, steryl dimethyl-monohydroxy-ethylammonium chloride, steryl dimethyl-monohydroxyethylammonium methylsulfate, di-$C_{12}$–$C_{14}$ alkyl dimethyl ammonium chloride, and mixtures thereof are also desirable. ADOGEN 412™, a lauryl trimethyl ammonium chloride commercially available from Witco, is also desirable. Other desirable surfactants are lauryl trimethyl ammonium chloride and myristyl trimethyl ammonium chloride.

Another group of suitable cationic surfactants are the alkanol amidal quaternary surfactants of the formula:

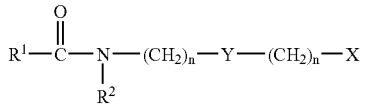

wherein $R^1$ can be $C_{10-18}$ alkyl or a substituted or unsubstituted phenyl; $R^2$ can be a $C_{1-4}$ alkyl, H, or $(EO)_y$, wherein y is from about 1 to about 5; Y is O or —$N(R^3)(R^4)$; $R^3$ can be H, $C_{1-4}$ alkyl, or $(EO)_y$, wherein y is from about 1 to about 5; $R^4$, if present, can be $C_{1-4}$ alkyl or $(EO)_y$, wherein y is from about 1 to about 5; each n is independently selected from about 1 to about 6, preferably from about 2 to about 4; X is hydroxyl or —$N(R^5)(R^6)(R^7)$, wherein $R^5$, $R^6$, $R^7$ are independently selected from $C_{1-4}$ alkyl, H, or $(EO)_y$, wherein y is from about 1 to about 5.

Amine Oxide Surfactants—The laundry detergent compositions herein also contain amine oxide surfactants of the formula:

$$R^1(EO)_x(PO)_y(BO)_zN(O)(CH_2R')_2.qH_2O \quad (I)$$

In general, it can be seen that the structure (I) provides one long-chain moiety $R^1(EO)_x(PO)_y(BO)_z$ and two short chain moieties, $CH_2R'$. R' is preferably selected from hydrogen, methyl and —$CH_2OH$. In general $R^1$ is a primary or branched hydrocarbyl moiety which can be saturated or unsaturated, preferably, $R^1$ is a primary alkyl moiety. When x+y+z=0, $R^1$ is a hydrocarbyl moiety having chainlength of from about 8 to about 18. When x+y+z is different from 0, $R^1$ may be somewhat longer, having a chainlength in the range $C_{12}$–$C_{24}$. The general formula also encompasses amine oxides wherein x+y+z=0, $R^1$=$C_8$–$C_{18}$, R' is H and q is 0–2, preferably 2. These amine oxides are illustrated by $C_{12-14}$ alkyldimethyl amine oxide, hexadecyl dimethylamine oxide, octadecylamine oxide and their hydrates, especially the dihydrates as disclosed in U.S. Pat. Nos. 5,075,501 and 5,071,594, incorporated herein by reference.

The invention also encompasses amine oxides wherein x+y+z is different from zero, specifically x+y+z is from about 1 to about 10, $R^1$ is a primary alkyl group containing 8 to about 24 carbons, preferably from about 12 to about 16 carbon atoms; in these embodiments y+z is preferably 0 and x is preferably from about 1 to about 6, more preferably from about 2 to about 4; EO represents ethyleneoxy; PO represents propyleneoxy; and BO represents butyleneoxy. Such amine oxides can be prepared by conventional synthetic methods, e.g., by the reaction of alkylethoxysulfates with dimethylamine followed by oxidation of the ethoxylated amine with hydrogen peroxide.

Desirable amine oxides herein are solids at ambient temperature, more preferably they have melting-points in the range 30° C. to 90° C. Amine oxides suitable for use herein are made commercially by a number of suppliers, including Akzo Chemie, Ethyl Corp., and Procter & Gamble. See McCutcheon's compilation and Kirk-Othmer review article for alternate amine oxide manufacturers. Other desirable commercially available amine oxides are the solid, dihydrate ADMOX 16 and ADMOX 18, ADMOX 12 and especially ADMOX 14 from Ethyl Corp.

Other embodiments include dodecyldimethylamine oxide dihydrate, hexadecyldimethylamine oxide dihydrate, octadecyldimethylamine oxide dihydrate, hexadecyltris(ethyleneoxy)dimethyl-amine oxide, tetradecyldimethylamine oxide dihydrate, and mixtures thereof. Whereas in certain embodiments R' is H, there is some latitude with respect to having R' slightly larger than H. Alternate embodiments include wherein R' is $CH_2OH$, such as hexadecylbis(2-hydroxyethyl)amine oxide, tallowbis(2-hydroxyethyl)amine oxide, stearylbis(2-hydroxyethyl)amine oxide and oleylbis(2-hydroxyethyl)amine oxide.

Enzymes

Enzymes can be included in the formulations herein for a wide variety of fabric laundering purposes, including removal of protein-based, carbohydrate-based, or triglyceride-based stains, for example, and for fabric restoration. The enzymes to be incorporated include proteases, amylases, lipases, and cellulases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01% to 1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms.* Another suitable protease is obtained from a strain of *Bacillus,* having maximum activity throughout the pH range of 8–12, developed and sold by Novo Industries A/S under the registered tradename ESPERASE. The preparation of this enzyme and analogous enzymes is described in British Patent Specification No. 1,243,784 of Novo. Proteolytic enzymes suitable for removing protein-based stains that are commercially available include those sold under the trade names ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and *Humicola* strain DSM1800 or a cellulase 212-producing fungus belonging to the genus *Aeromonas,* and cellulase extracted from the hepatopancreas of a marine mollusk (*Dolabella Auricula Solander*). Suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the *Pseudomonas* group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum,* e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Diosynth Co., The Netherlands, and lipases ex *Pseudomonas gladioli.* The LIPOLASE enzyme derived from *Humicola lanuginosa* and commercially available from Novo (see also EPO 341,947) is a preferred lipase for use herein.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

The enzymes employed herein may be stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species. See Severson, U.S. Pat. No. 4,537,706. Typical detergents, especially liquids, will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water. In solid detergent compositions the formulation may include a sufficient quantity of a water-soluble calcium ion source to provide such amounts in the laundry liquor. In the alternative, natural(water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The laundry detergent compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 4%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Polymeric Soil Release Agent

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

Examples of polymeric soil release agents useful herein include U.S. Pat. No. 4,721,580, issued Jan. 26, 1988 to Gosselink; U.S. Pat. No. 4,000,093, issued Dec. 28, 1976 to Nicol, et al.; European Patent Application 0 219 048, published Apr. 22, 1987 by Kud, et al.; U.S. Pat. No. 4,702,857, issued Oct. 27, 1987 to Gosselink; U.S. Pat. No. 4,968,451, issued Nov. 6, 1990 to J. J. Scheibel. Commercially available soil release agents include the SOKALAN type of material, e.g., SOKALAN HP-22, available from BASF (West Germany). Also see U.S. Pat. No. 3,959,230 to Hays, issued May 25, 1976 and U.S. Pat. No. 3,893,929 to Basadur issued Jul. 8, 1975. Examples of this polymer include the commercially available material ZELCON 5126 (from Dupont) and MILEASE T (from ICI). Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink. Preferred polymeric soil release agents also include the soil release agents of U.S. Pat. No. 4,877,896, issued Oct. 31, 1989 to Maldonado et al.

If utilized, soil release agents will generally comprise from about 0.01% to about 10.0%, by weight, of the detergent compositions herein, typically from about 0.1% to about 5%, preferably from about 0.2% to about 3.0%.

Clay Soil Removal/Anti-redeposition Agents

The laundry detergent compositions of the present invention can also optionally contain water-soluble ethoxylated amines having clay soil removal and antiredeposition properties. Liquid detergent compositions typically contain about 0.01% to about 5%.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred antiredeposition agent includes the carboxy methyl cellulose (CMC) materials. These materials are well known in the art.

Polymeric Dispersing Agents

Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Brightener

Any optical brighteners or other brightening or whitening agents known in the art can be incorporated at levels typically from about 0.05% to about 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal SBM; available from Ciba-Geigy; Artic White CC and Artic White CWD, available from Hilton-Davis, located in Italy; the 2-(4-stryl-phenyl)-2H-napthol[1,2-d]triazoles; 4,4'-bis-(1,2,3-triazol-2-yl)-stil- benes; 4,4'-bis(stryl)bisphenyls; and the aminocoumarins. Specific examples of these brighteners include 4-methyl-7-methyl- amino coumarin; 1,2-bis(-venzinidazol-2-yl)ethylene; 1,3-diphenyl-phrazolines; 2,5-bis (benzoxazol-2-yl)thiophene; 2-stryl-napth-[1,2-d]oxazole; and 2-(stilbene-4-yl)-2H-naphtho-[1,2-d]triazole. See also U.S. Pat. No. 3,646,015, issued Feb. 29, 1972 to Hamilton. Anionic brighteners are preferred herein.

Suds Suppressors

Compounds for reducing or suppressing the formation of suds can be incorporated into the compositions of the present invention. Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The laundry detergent compositions herein may also contain non-surfactant suds suppressors. These include, for example:highmolecularweighthydrocarbonssuchasparaffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526.

In the preferred silicone suds suppressor used herein, the solvent for a continuous phase is made up of certain polyethylene glycols or polyethylene-polypropylene glycol copolymers or mixtures thereof (preferred), or polypropylene glycol. The primary silicone suds suppressor is branched/crosslinked and preferably not linear.

To illustrate this point further, typical liquid laundry detergent compositions with controlled suds will optionally comprise from about 0.001 to about 1, preferably from about 0.01 to about 0.7, most preferably from about 0.05 to about 0.5, weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. See also U.S. Pat. No. 4,978,471, Starch, issued Dec. 18, 1990, and U.S. Pat. No. 4,983,316, Starch, issued Jan. 8, 1991, U.S. Pat. No. 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount. By "suds suppressing amount" is meant that the formulator of the composition can select an amount of this suds controlling agent that will sufficiently control the suds to result in a low-sudsing laundry detergent for use in automatic laundry washing machines.

The laundry detergent compositions herein will generally comprise from 0% to about 5% of suds suppressor. When utilized as suds suppressors, monocarboxylic fatty acids, and salts therein, will be present typically in amounts up to about 5%, by weight, of the detergent composition. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Dye Transfer Inhibiting Agents

The laundry detergent compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: $R\text{-}A_x\text{-}P$; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N=; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

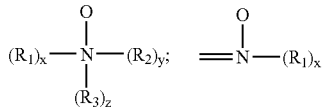

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000;

more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis,* Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The laundry detergent compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The laundry detergent compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention are those having the structural formula:

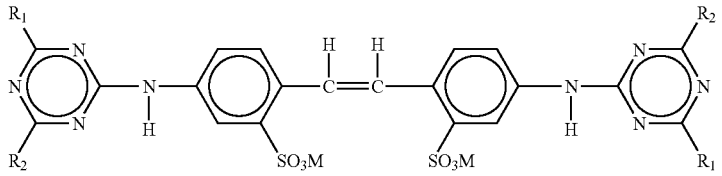

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

Bleaching Compounds—Bleaching Agents and Bleach Activators

The laundry detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetra-hydrate) and percarbonate bleaches can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. Pat. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamidocaproyl)oxybenzenesulfonate, (6-nonanamidocaproyl)oxybenzenesul-fonate, (6-decanamidocaproyl)oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. Still another class of preferred bleach activators includes the acyl lactam activators, especially acyl caprolactams and acyl valerolactams. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1. As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Anti-Static Agents

The laundry detergent compositions can also comprise anti-static agents as illustrated in U.S. Pat. No. 4,861,502. Preferred examples of anti-static agents include alkyl amine-anionic surfactant ion pairs, such as distearyl amine-cumene sulfonate ion pairs. If present, anti-static agents are present in an amount of from about 0.5% to about 20%, preferably from about 1% to about 10%, more preferably from about 1% to about 5%, by weight of the detergent composition.

In the following Example A, an embodiment of the present invention of a granular cyclodextrin agglomerate is exemplified. The Odor Loading Factor of the cyclodextrin granules is at least about 50:

EXAMPLE A

| Ingredient | Wt % |
|---|---|
| Zeolite | 85.00 |
| Cyclodextrin | 15.00 |
| Total | 100.0% |

In the following Example B, an embodiment of the present invention of a laundry detergent composition having a granular cyclodextrin agglomerate is exemplified. The Odor Loading Factor of the cyclodextrin granules is at least about 50:

EXAMPLE B

| Ingredient | Wt % |
|---|---|
| Granular cyclodextrin agglomerate of Example A | 5.00 |
| Laundry detergent having enzymes, builders, surfactants known to those skilled in the art | 95.00 |
| Total | 100.0% |

Accordingly, having thus described the invention in detail, it will be obvious to those skilled in the art that various changes may be made without departing from the scope of the invention and the invention is not to be considered limited to what is described in the specification.

What is claimed is:

1. A process for forming a laundry detergent composition comprising a free flowing cyclodextrin capable of removing malador from laundered items during automatic laundry washing comprising the steps of:

(a) forming uncomplexed cyclodextrin granules from a mixture of water soluble cyclodextrin powder substantially free of perfume, an inorganic compound selected from the group consisting of sulfates, carbonates, silicates, aluminosilicates, phosphates, silica, citrares, perborate, talc and mixtures thereof, and an aqueous medium;

(b) particulizing said cyclodextrin granules to a particle size in a range of from about 100 microns to about 1200 microns;

(c) admixing said cyclodextrin granules in a laundry detergent composition a laundry detergent product having thereby forming cyclodextrin granules that have an odor loading factor of at least about 50 when said cyclodextrin granules are dispersed in a wash solution during an automatic laundry washing process.

2. The process according to claim 1, wherein said cyclodextrin granules are formed using a granulating process selected from the group consisting of agglomeration, spray-drying, extrusion, fluid-bed agglomeration, roll-compaction, freeze-drying and tabletting.

3. The process according to claim 1, wherein said cyclodextrin powder comprises cyclodextrins having cavities of different sizes selected from the group consisting of alpha-, beta- and gamma-cyclodextrins, and water-soluble derivatives thereof.

4. The process according to claim 1, wherein said inorganic compound is an aluminosilicate ion exchange material of the formula, $M_{m/n}[(AlO_2)_m(SiO_2)_y].xH_2O$ where n is the valence of the cation M, x is the number of water molecules per unit cell, m and y are the total number of tetrahedra per unit cell, and y/m is 1 to 100, and wherein M is selected from the group consisting of sodium, potassium, magnesium, and calcium.

5. The process according to claim 4, wherein said inorganic compound is zeolice.

6. The process according to claim 5 wherein said cyclodextrin granules have a size in a range of from about 200 microns to about 800 microns.

7. The process according to claim 1, wherein said cyclodextrin granules have a odor loading factor of at least about 65.

8. The process according to claim 7, wherein said cyclodextrin granules have a odor loading factor of at least about 80.

9. The process according to claim 1, wherein said cyclodextrin and said inorganic compound are mixed in a weight ratio in a range of from about 10:90 to about 90:10 respectively.

10. A method of using cyclodextrin in a laundry detergent composition far removing malodor from laundered items during automatic laundry washing, comprising the steps of:

(a) forming uncomplexed cyclodextrin granules from a mixture of water soluble cyclodextrin powder substantially free of perfume, an inorganic compound selected from the group consisting of sulfates, carbonates, silicates, aluminosilicates, phosphates, silica, citrates, perborate, talc and mixtures thereof, and an aqueous medium;

(b) particulizing said cyclodextrin granules to a particle size in a range of from about 100 microns to about 1200 microns;

(c) ad-mixing said cyclodextrin granules in a laundry detergent composition, in a range of from about 0.1% to about 50% by weight cyclodextrin granules; thereby forming a laundry detergent product having cyclodextrin granules that have an odor loading factor of at least about 50 when said cyclodextrin granules are dispersed in a wash solution during an automatic laundry washing process.

11. The process according to claim 10, wherein said cyclodextrin granules are formed using a granulating process selected from the group consisting of agglomeration, spray-drying, extrusion, fluid-bed agglomeration, roll-compaction, freeze-drying and tabletting.

12. The process according to claim 10, wherein said cyclodextrin powder comprises cyclodextrins having cavities of different sizes selected from the group consisting of alpha-, beta- and gamma-cyclodextrins, and water-soluble derivatives thereof.

13. The process according to claim 12, wherein said inorganic compound is an aluminosilicate ion exchange material of the formula, $M_{m/n}[(AlO_2)_m(SiO_2)_y].xH_2O$ where n is the valence of the cation M, x is the number of water molecules per unit cell, m and y are the total number of tetrahedra per unit cell, and y/m is 1 to 100, and wherein M is selected from the group consisting of sodium, potassium, magnesium, and calcium.

14. The process according to claim 13, wherein said inorganic compound is zeolite.

15. The process according to claim 10, wherein said cyclodextrin granules have a size in a range of from about 200 microns to about 800 microns.

16. The process according to claim 10, wherein said cyclodextrin granules have a loading factor of at least about 65.

17. The process according to claim 16, wherein said cyclodextrin granules have a loading factor of at least about 80.

18. The process according to claim 10, wherein said cyclodextrin and said inorganic compound are mixed in a weight ratio in a range of from about 10:90 to about 90:10 respectively.

* * * * *